US005538434A

United States Patent [19]

DelGuidice et al.

[11] Patent Number: 5,538,434

[45] Date of Patent: Jul. 23, 1996

[54] ELECTRICAL CONNECTOR WITH INTEGRAL SHORTING ASSEMBLY

[75] Inventors: Henry L. DelGuidice, Winston-Salem; Victor E. Slack, Lewisville; Harry R. Lowry, Winston-Salem, all of N.C.; Clifford F. Lincoln, Atlanta, Ga.

[73] Assignee: The Whitaker Corporation, Wilmington, Del.

[21] Appl. No.: 245,343

[22] Filed: May 18, 1994

[51] Int. Cl.[6] ..... H01R 29/00

[52] U.S. Cl. ..... 439/188

[58] Field of Search ..... 439/509, 507, 439/513, 188, 284, 291

[56] References Cited

U.S. PATENT DOCUMENTS

| | | | |
|---|---|---|---|
| 4,449,778 | 5/1984 | Lane . | |
| 4,602,833 | 7/1986 | Grabbe et al. | 339/19 |
| 4,619,494 | 10/1986 | Noorily et al. . | |
| 4,671,599 | 6/1987 | Olsson | 439/188 |
| 4,682,836 | 7/1987 | Noorily et al. | 439/426 |
| 4,744,769 | 5/1988 | Grabbe | 439/509 X |
| 4,820,194 | 4/1989 | Stine | 439/510 |
| 5,071,362 | 12/1991 | Martens et al. | 439/188 |
| 5,195,902 | 3/1993 | Bengal | 439/188 |
| 5,266,093 | 11/1993 | Giroux et al. | 439/188 OR |
| 5,370,543 | 12/1994 | Hamada et al. | 439/188 OR |
| 5,391,087 | 2/1995 | Fukuda | 439/188 OR |

*Primary Examiner*—P. Austin Bradley
*Assistant Examiner*—Daniel Wittels

[57] ABSTRACT

Invention relates to a high performance electrical data connector of the type which may be mated with a like connector. The connector comprises an insulative housing having a connector mating face and a conductor receiving face, a floor extending between the faces and a pair of upstanding side walls, plural contact terminals upstanding from the floor intermediate the mating face and the conductor receiving face. The plural contact terminals comprise a conductor receiving portion, a base portion, and a resilient tongue portion reversely bent from the base portion and extending toward the connector mating face. An important feature hereof is the provision of an insulative member integrally molded between the side walls and overlying at least part of each resilient tongue portion, where the insulative member includes staggered plural through slots. Each slot contains a formed shorting assembly consisting of a U-shaped configured, oxide resistant wire having a circular cross section, where the assembly comprises a base portion and a pair of arms angularly extending therefrom, and each arm terminates in an end portion adapted to contact one resilient tongue portion, of a preselected pair of terminals, when the connector is in an unmated condition. By the use of the specially configured, oxide resistant shorting assembly, the skin effect and other factors affecting insertion loss are reduced resulting in improved performance.

15 Claims, 6 Drawing Sheets

ELECTRICAL CONNECTOR WITH INTEGRAL SHORTING ASSEMBLY

BACKGROUND OF THE INVENTION

This invention relates to an enhanced, high frequency, electrical data connector that includes a shorting system support integrally molded to the connector housing, where such system offers significantly reduced insertion loss for electrical signals communicated through the connector through decreased capacitive coupling and decreased mutual inductance between conductors, and lowered skin resistance and self inductance of the conductors.

Insertion loss, or attenuation, defined as the inductive and capacitive coupling from an active line or lines into another, causes degradation of signals, has been recognized for years and represented a performance limitation to increased data communication rates. Only recently, performance standards were established by the Telecommunications Industry Association (TIA) in cooperation with the Electronic Industries Association (EIA) for STP, or shielded twisted pairs of conductors. Specifically, the EIA/TIA established performance standards for various categories of products operating at frequencies up to 300 MHz, where STP-A products have the highest performance standards.

STP-A products, where the transmission requirements of such products are characterized up to 300 MHz, are typically intended for emerging applications with transmission rates up to 300 Mbps, or higher through encoding or wave reshaping. The standard is preliminarily identified as SP-2840, May 1993. While the invention hereof relates to the hardware or connector, it is important to note that the hardware is only one major component of a communication system. The other major component is the transmission cable. Thus, it is important to insure the use of the correct connecting component or hardware that is compatible with the transmission characteristics of the cable. Such cables may typically be high performance unshielded twisted-pair (STP) cables, the performance characteristics of which are covered by EIA/TIA bulletin SP-2840, which when adopted will be titled, "EIA/TIA-568, Commercial Building Telecommunications Wiring Standard."

Insertion loss, or attenuation, for the connectors is defined as a measure of signal power loss due to the connecting hardware and is derived from swept frequency voltage measurements on short lengths of 150 ohm shielded pair test leads before and after splicing-in the connectors under test. The worst case insertion loss, after cable calibration, STP-A connecting hardware is listed below in TABLE I.

TABLE I 150 ohm STP-A Connecting Hardware
Maximum Insertion Loss Limits As Specified
In EIA/TIA Document SP2840/568
For Prime And Self-Shorting Paths

| Frequency | Maximum (dB) |
|---|---|
| 100.0 KMHz | .05 |
| 4.0 MHz | .05 |
| 8.0 | .10 |
| 10.0 | .10 |
| 16.0 | .15 |
| 31.25 | .15 |
| 62.50 | .20 |
| 100.0 | .25 |
| 300.0 | .45 |

Insertion loss performance standards have now been extended to include STP, or shielded twisted pairs of conductors, at frequencies greater than 100 MHz under EIA/TIA SP2840-568, where such standards exceed Category 5 for UTP with signal frequencies up to 300 MHz.

The present invention represents an enhancement to the shielded data connector disclosed and claimed in copending application U.S. Ser. No. 08/101,529, filed Aug. 3, 1993, assigned to the Assignee hereof, where the disclosure of such copending application is incorporated herein by reference.

The use of shielded electrical connectors, generally, is well-known. Certain types of applications, such as computer systems, require connectors which will both reliably establish an electrical connection and provide shielding for the data signal conductors. In many applications, this shielding is coupled to the shield braid of a shielded cable. Typically, the cables utilize shielded twisted pair conductors to minimize signal cross-talk within the cable.

Conventional shielded electrical connectors provide for shielding around the connector, to minimize adverse interference from outside to the connector to signals being conducted within the connector. Such connectors have been widely used. Conventional connectors, however, do not address the possibility of signal cross-talk or insertion loss proximate the termination of each conductor, where the twisted pairs are no longer intertwined. Accordingly, while conventional connectors guard against signal interference from outside the connector, they do not include provisions for controlling cross-talk or insertion loss between signal conductors inside the connector.

In the copending application reduced insertion loss is achieved by means within the hardware, i.e. connector. In one embodiment thereof, a shield member extends between the conductors of two different twisted pairs as they extend beyond the cable shield. In one preferred embodiment, the shield assembly also includes conductive surfaces which extend around at least a portion of the contact assembly i.e., between the contact assembly and at least portions of the upper, lower, and side surfaces of the connector housing. Also in this preferred embodiment, contact portions of each of the electrical contacts will extend in generally parallel relation to one another, but contact portions of contacts coupled to conductors of different signals are spaced from one another by an air gap along at least a portion of their parallel-extending length.

Improved insertion loss performance for the connector herein, particularly a 4-position data connector, is achieved by the inclusion therein of an integral shorting assembly which utilizes a pair of formed, U-shaped, circular conductors having a non oxidizing surface where which the respective ends of the legs are reversely bent, while providing closed loop shorting.

The use of a shunt or shorting assembly in electrical connectors has been known to ensure electrical continuity during periods of unmating, for example, or provide rerouting of signals during periods of unmating for selected conductors within the connector, i.e. a token ring system.

U.S. Pat. No. 4,449,778 discloses as a preferred embodiment thereof a shielded 4-position data connector which uses a pair of identical, stamped shunting bars, where the shunting bars are spaced-apart and parallelly arranged in aligned slots in the connector housing and oriented with different pairs of the four terminals in the connector to provide shunting between the terminals of a given pair.

U.S. Pat. No. 4,682,836 is directed principly to a latching mechanism for a pair of matable electrical data connectors.

However, in the construction of the connectors, the patent discloses the use of a discrete insertable member or block into which a pair of staggered slots have been provided to receive complementary shunting elements formed of metal wire, each shaped as a channel with laterally extending feet. Typically, such channel shaped shunting elements are bottom loaded into the slots of the block, with the feet exposed to contact a pair of terminals within the connector, whereupon the block is inserted into a shunting position in the connector housing.

The present invention provides an effective system for providing a closed loop arrangement through shunting or shorting, while offering superior reduced cross-talk performance and insertion loss in a shielded electrical data connector. These and other features will become apparent in the description which follows, particularly when read in conjunction with the accompanying drawings.

SUMMARY OF THE INVENTION

This invention is directed to an enhanced, high frequency, electrical data connector that offers significantly reduced cross-talk and insertion loss between electrical signals communicated through the connector. A preferred embodiment of the connector, of the type which may be mated with a like connector, comprises an insulative housing having a connector mating face, a conductor receiving face, a floor extending between said faces, and a pair of upstanding side walls. Plural contact terminals are provided to upstand from the floor intermediate the mating face and the conductor receiving face. Each contact terminal comprises a conductor receiving portion, a base portion, and a resilient tongue portion reversely bent from the base portion and extending toward the connector mating face. Further, an insulative member, integrally molded between the side walls and overlying at least part of each resilient tongue portion is included. The insulative member includes staggered plural through slots, where each slot contains a formed shorting assembly consisting of a U-shaped configured, circular conductor having a non-oxidizing surface. Specifically, each assembly comprises a base portion and a pair of arms angularly extending therefrom, where each arm terminates in an end portion adapted to contact one resilient tongue portion, of a preselected pair of terminals, when the connector is in an unmated condition.

DETAILED DESCRIPTION OF PREFERRED EMBODIMENT

Figure 1:
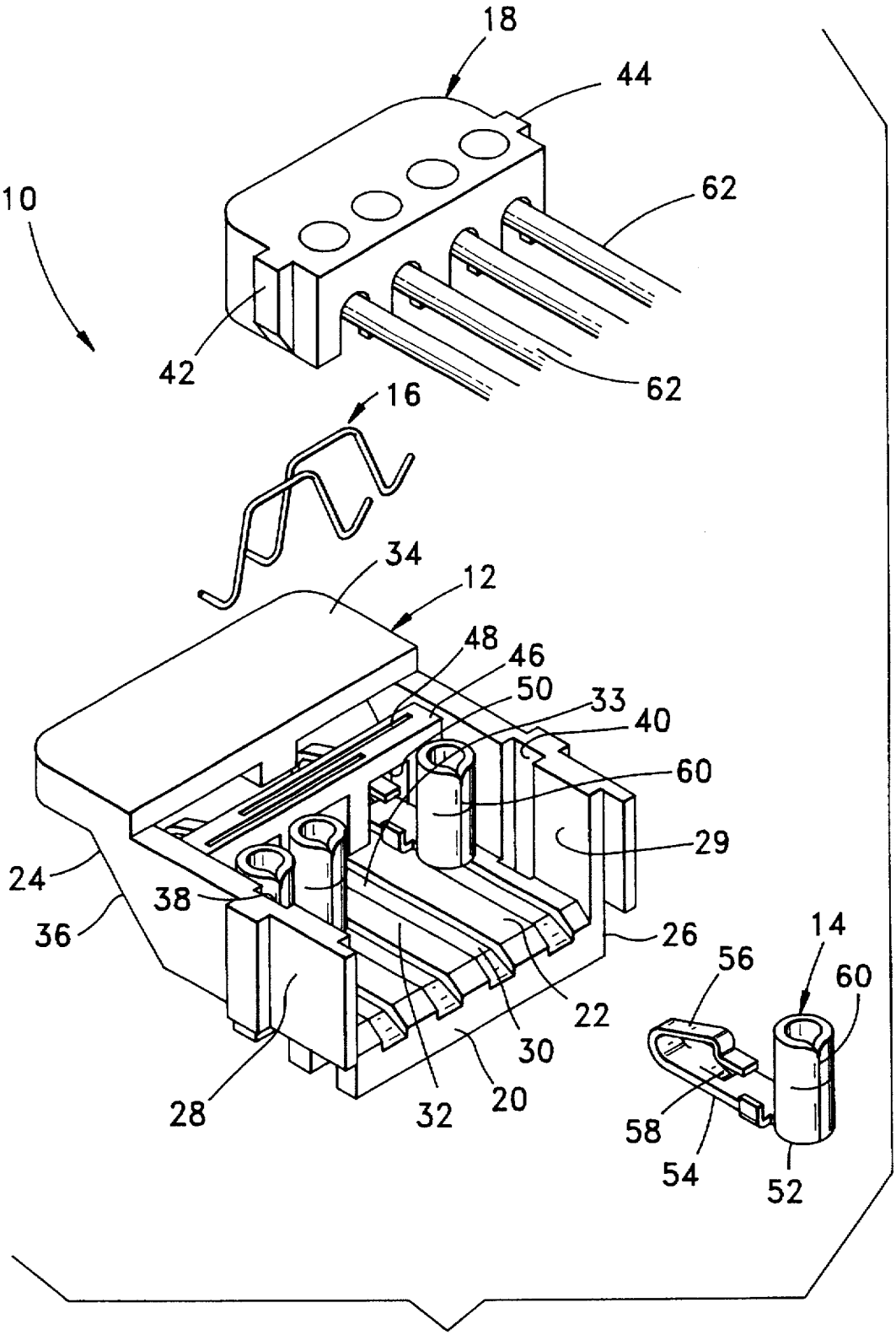
FIG. 1 is an exploded perspective view of a first electrical data connector incorporating the features of this invention.
Figure 2:
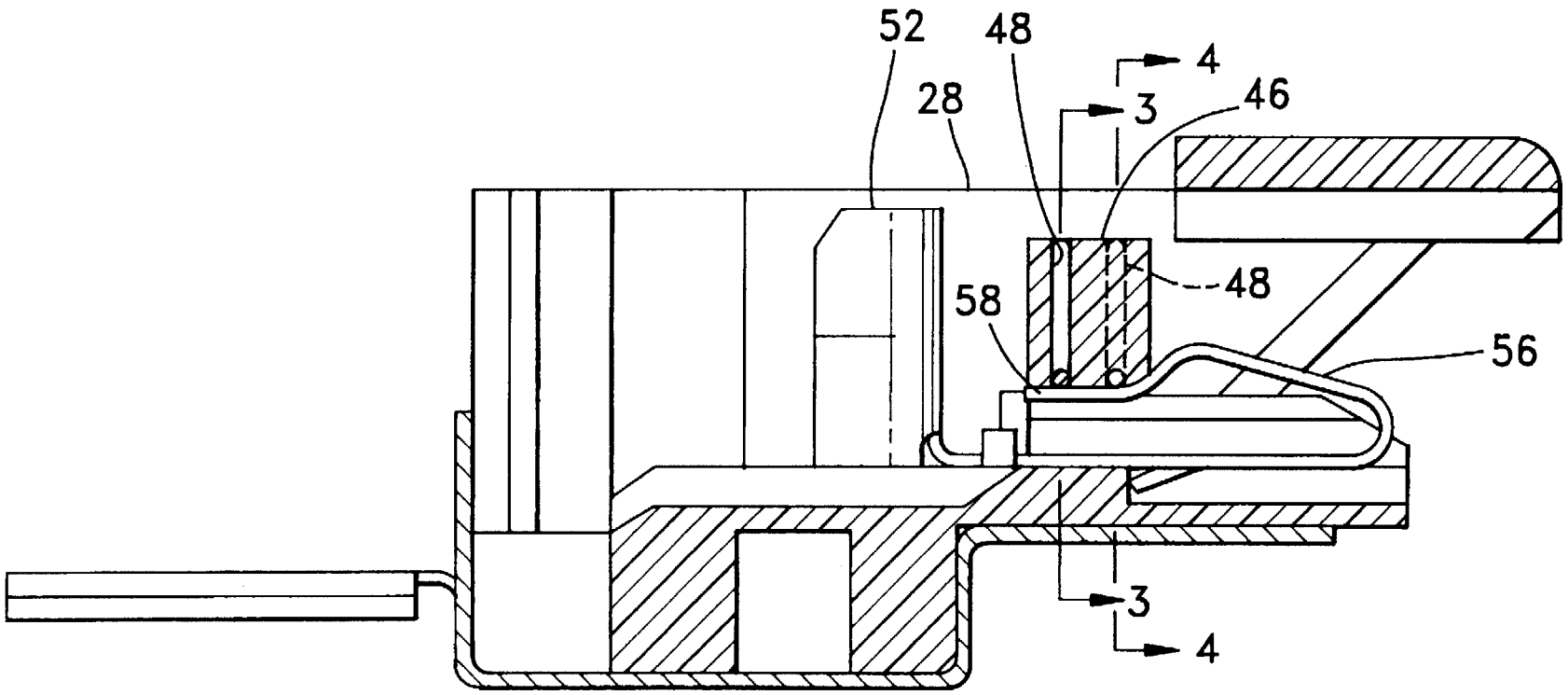
FIG. 2 is an enlarged sectional view taken longitudinally through the assembled connector of FIG. 1.

The present invention is directed to an enhanced, high frequency, electrical data connector of the type disclosed in U.S. Ser. No. 08/101,529, where such connector is adapted to be mated with a like connector. A preferred embodiment thereof is illustrated in the several Figures, with FIG. 1 showing the various components in an exploded fashion.

The connector 10 of this invention comprises a housing 12, a terminal contact 14, shorting assembly 16 (two being shown in FIG. 1), and a conductor stuffer member 18. While only one connector has been illustrated, it should be understood that a like connector of a hermaphroditic construction will be mated therewith, a concept known in the art for data communication connectors. Accordingly, the description which follows will be limited to the single connector.

Figure 3:
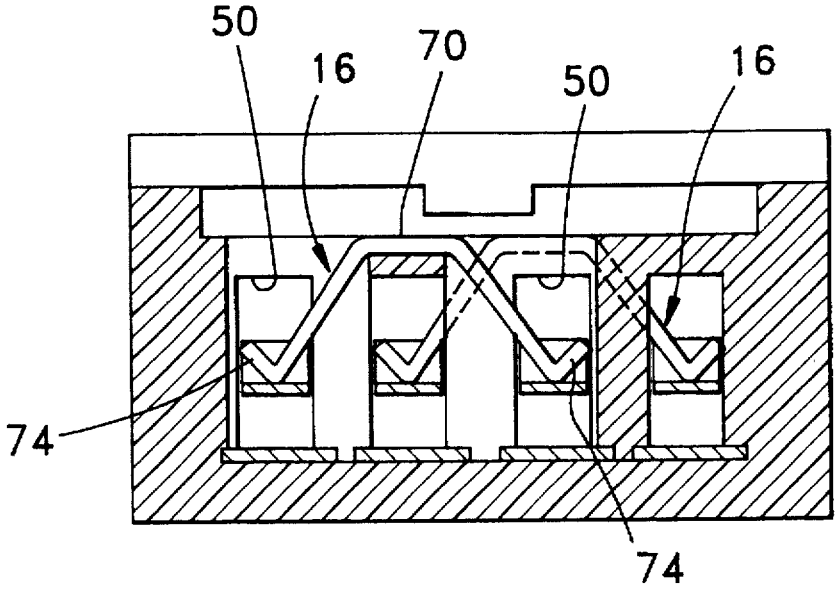
FIG. 3 is a sectional view taken along line 3—3 of the connector of FIG. 2.
Figure 4:
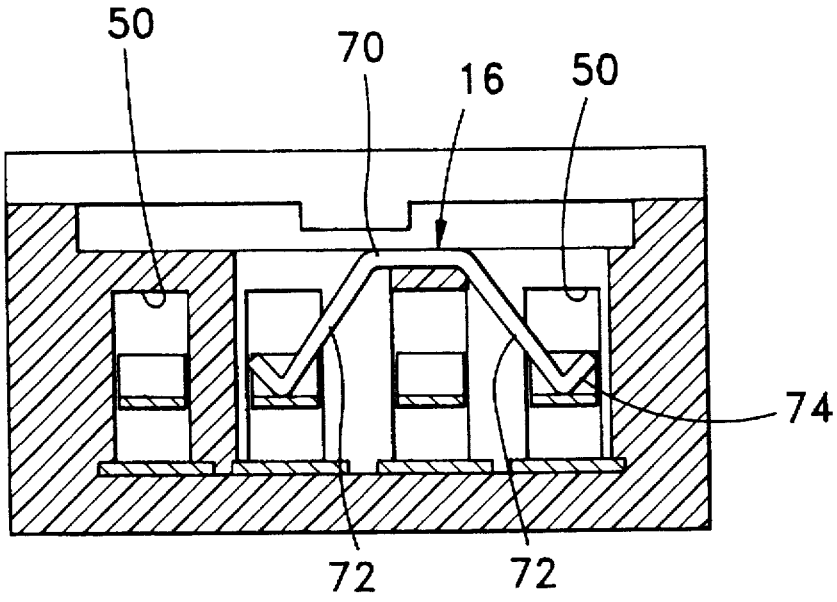
FIG. 4 is a sectional view taken along line 4—4 of the connector of FIG. 2.

The connector housing 12, may be molded in one piece from a dielectric material and metal plated for shielding, comprises a base 20 supporting a floor 22 extending between a connector mating face 24 and a conductor receiving face 26, where the floor 22 laterally is defined by a pair of side walls 28, 29. A series of parallel channels 30 extend forwardly across the floor 22 from the conductor receiving face 26 defining between them undercut terminal supporting ribs 32. Parallel locking grooves 33 extend rearwardly in alignment with the ribs from the front of the platform in a manner known in the art. Side walls 28 and 29 upstand from respective opposite side edges of the floor and are bridged at a front end by a hood 34. The side walls have canted leading edges 36 extending from locations adjacent the floor 22 to locations adjacent the front end of the hood. Interiorly the side walls 28, 29 are further provided with a pair of opposed slots 38, 40 adapted to receive in sliding engagement respective ribs 42, 44 of conductor stuffer member 18. A further feature of the housing 12 is the provision of transverse wall 46, integrally molded to the housing between side walls 28, 29. The transverse wall includes plural slots or recesses 48 which overlie portions of the contact terminals, as hereinafter explained. Communicating with the recesses 48 are plural through slots 50, staggered laterally, such that the respective ends of the slots overlie alternate recesses, namely recesses 1–3 and 2–4 in a 4-position data connector, see FIGS. 3 and 4.

The terminal contact 14, one for each of the grooves 33, comprises a member stamped and formed from a single metal blank, having a wire barrel portion 52, a base portion 54, and a resilient tongue 56 reversely bent from the base portion 54. The remote end of the resilient tongue 56 includes a stepped end 58, which, as noted hereinafter, is the contact location for the shorting assembly 16. Finally, the barrel portion 52 includes a vertical IDC slot 60 into which the conductors 62 are received, a procedure well known in the art, by means of the stuffer member 18.

Figure 5:
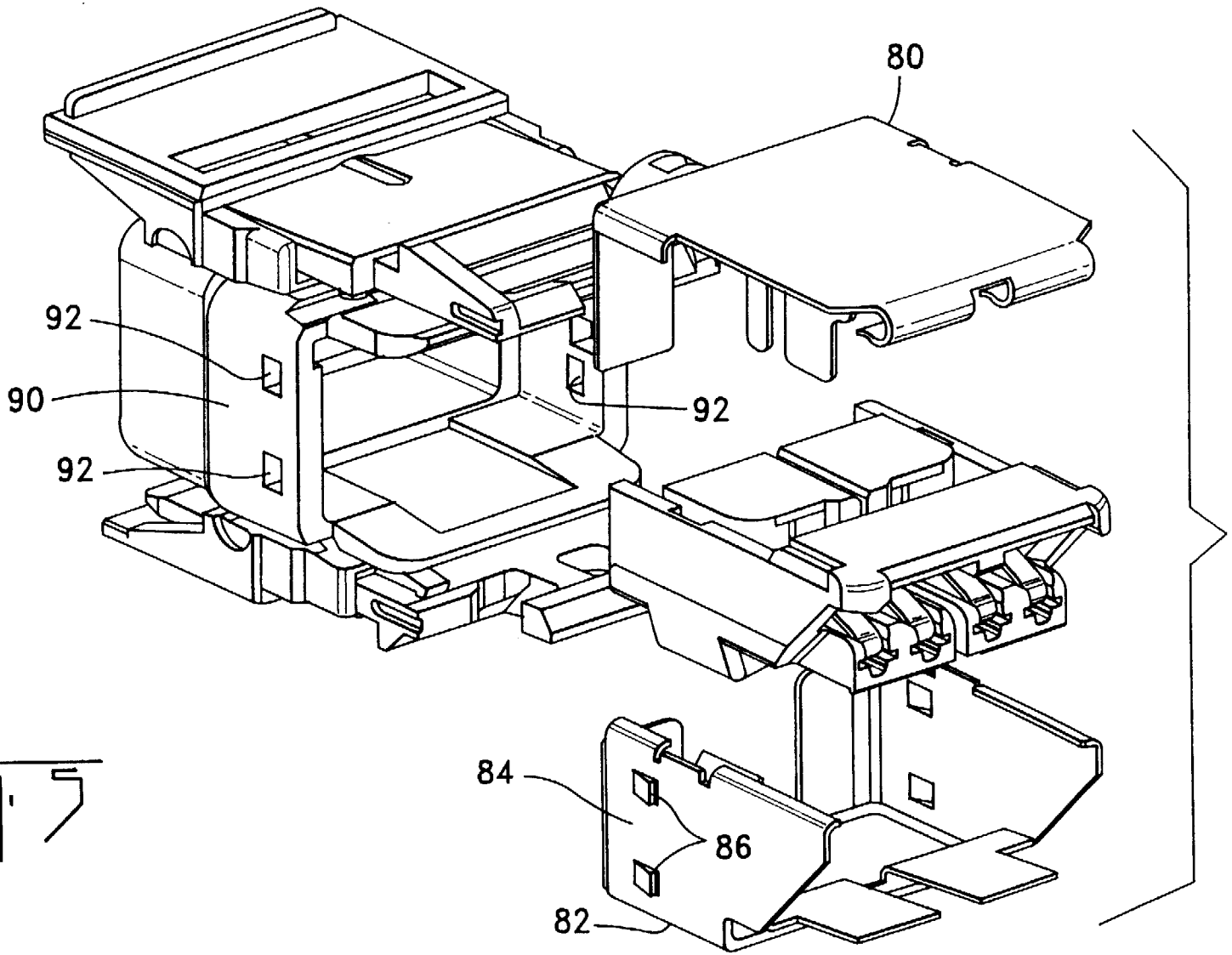
FIG. 5 is an exploded perspective view of an alternate embodiment of the enhanced connector of this invention, such embodiment showing an externally applied metal shielding member.
Figure 6:
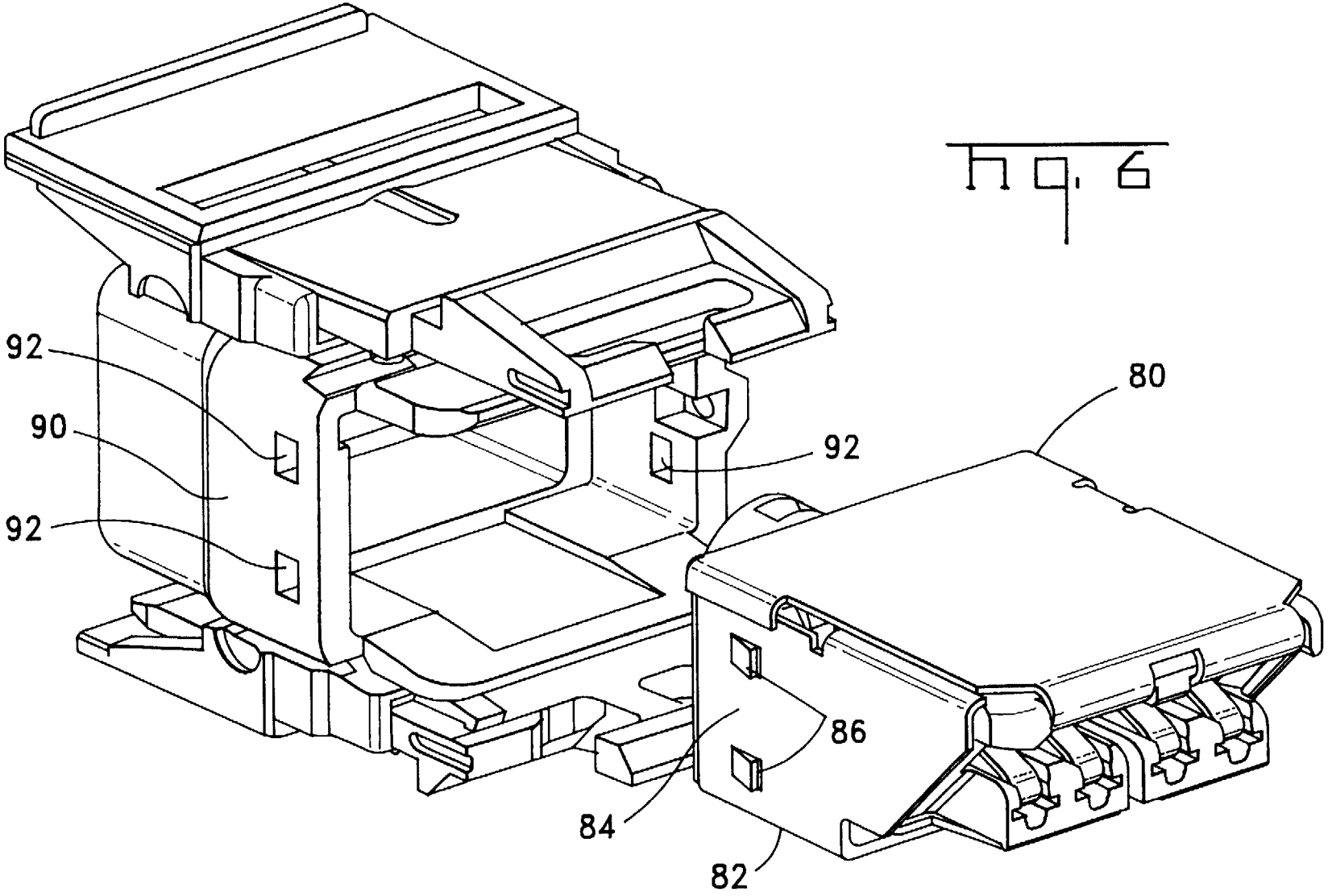
FIG. 6 is a perspective view of the shielded connector of FIG. 5, showing the connector prior to its insertion into a complementary housing.

FIGS. 5 and 6 illustrates an alternate embodiment of the connector of this invention by the use of externally attached top and bottom shielding members 80,82. As shown in FIG. 6, the shielding members 80,82, typically stamped and formed from a sheet metal blank, are arranged to overlie the connector top and bottom, respectively, and latch to provide full shielding about the connector. The sides 84 of the bottom shielding member may be provided with a pair of latching arms 86, struck from the sheet metal blank, to secure the connector within a complementary housing 90. That is the latching arms 86 are adapted to be received in complementary recesses 92 located in the respective sides of the housing 90.

An integral feature of this invention is the provision of a shorting assembly 16, where a preferred embodiment thereof are plural channel shaped configured wires, circular in cross section, and comprising a tempered copper alloy core with preferably overlying plated layers of gold over palladium, where a typical cross section reveals a core of about 0.0253 inches diameter, with each plating layer having a thickness of from 30 to 50 microinches. Each shorting assembly consists of a formed circular wire element having a lateral portion 70 and a pair of angularly disposed arms 72, preferably angled at about 45°, terminating in reverse bent ends 74. By the use of a tempered copper alloy core, where such alloy has the ability to be flexed and returned to its preflexed state, the shorting assembly 16 may be squeezed for insertion into slot 48, then allowed to resile into the position illustrated in FIGS. 3 and 4.

Figure 7:
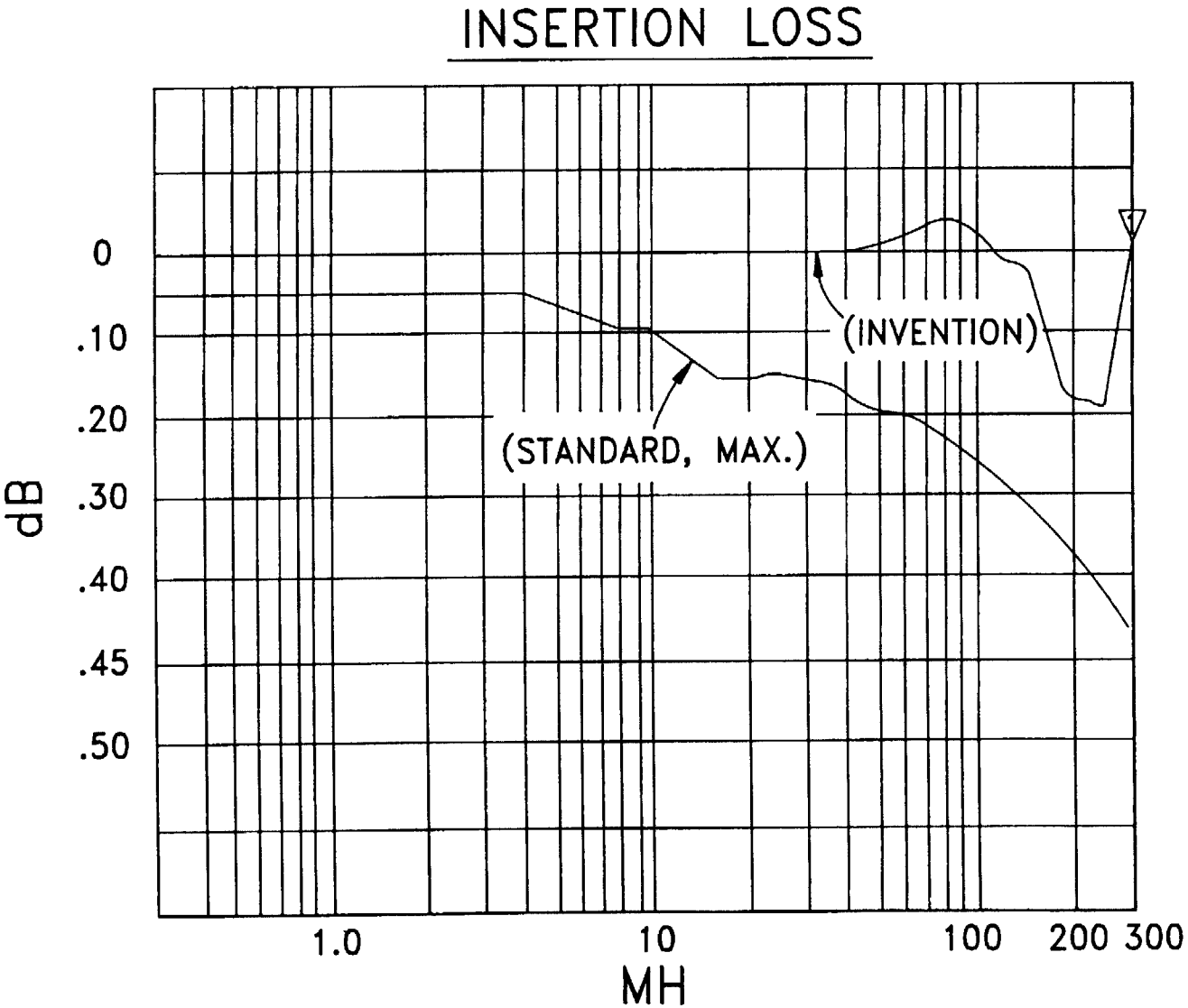
FIG. 7 is a graph illustrating the insertion loss performance of a connector according to this invention, against an industry standard.

It was discovered that improvements were achieved in the use of the Au/Pd plated copper, or copper alloy, over that of copper or copper alloy alone (such as phosphor bronze 510), or even a Au/Ni plated copper or copper alloy core. It was further discovered that unplated copper, depending in large measure on the environmental conditions to which the copper is exposed, may readily develop a layer of oxide which can adversely effect, ie. increase, the contact resistance. While gold over palladium remains the preferred embodiment, since gold is virtually non-oxidizing, gold over nickel or a stainless steel shorting bar, such as a Type 316 stainless steel, are viable alternatives. In all cases, an oxide free surface is provided. A second preferred feature of the shorting bar assembly is the use of a conductor having a circular configuration. Turning now to FIG. 7, the figure graphically illustrates the insertion loss performance of the Au/Pd plated Cu shorting bar, where the results thereof are well within the range of values allowed, particularly at frequencies below 300 MHz. That is, it was noted that through lowering line resistance and line inductance by substituting a non ferromagnetic inner plating layer, namely palladium to act as a diffusion barrier to the copper core and gold outer layer, for ferromagnetic electro plated nickel over copper, where the palladium nickel further acts as a porosity block, and thereby minimizes the effects of skin effect on terminals.

By way of brief background, electromagnetic waves of a conductor are sinusoidal in configuration, traversing the conductor at spaced apart locations. The waves penetrate the conductor at such locations from the outside toward the inside of the conductor, where the amount of penetration is dependent upon frequency, conductivity or resistivity, and permeability of plating and conductor materials. As the waves traverse the conductor, there is a loss in energy. The amount of penetration is referred to as "skin depth." It is believed that by the preferred selection of materials, such as gold/palladium over copper or copper alloy, there will be seen a significant reduction in the skin effect which results in a high performance electrical data connector having a dB at frequencies of up to 300 MHz that is below the EIA/TIA standards for STP-A products.

We claim:

1. An electrical data connector of the type which may be mated with a like connector, said connector comprising an insulative housing having a connector mating face and a conductor receiving face, a floor extending between said faces and a pair of upstanding side walls, plural contact terminals upstanding from said floor intermediate said mating face and said conductor receiving face, where said plural contact terminals comprise a conductor receiving portion, a base portion, and a resilient tongue portion reversely bent from said base portion and extending toward said connector mating face, and an insulative member integrally molded between said side walls and overlying at least part of each said resilient tongue portion, said insulative member including staggered plural through slots, where each slot contains a formed shorting assembly consisting of a U-shaped configured, circular cross sectioned conductor having a non-oxidizing surface, where said assembly comprises a base portion and a pair of arms angularly extending therefrom, each said arm terminating in an end portion adapted to contact one resilient tongue portion, of a preselected pair of terminals, when said connector is in an unmated condition, wherein said connector exhibits insertion loss performance levels of less than 0.45 dB at frequencies up to 300 MHz.

2. The electrical data connector according to claim 1, wherein said conductor is a copper based wire of a tempered alloy having a non-oxidizing metal coating thereon, and that said assembly may be flexed for insertion into said slot and resile into locking engagement within said slot.

3. The electrical data connector according to claim 1, wherein said connector is a four position data connector having four aligned contact terminals, and that two shorting assemblies are used, where one said angularly extending arm from each said assembly is arranged to overlie in a non-contact relationship at an essentially right angle to one another.

4. The electrical data connector according to claim 1, wherein a pair of interfitting metal shielding members are arranged about said insulative housing to provide shielding therefor.

5. The electrical data connector according to claim 1, wherein said insulative housing includes an outer metal plated surface to provide shielding therefor.

6. The electrical data connector according to claim 1, wherein said conductor is a member selected from the group consisting of gold plated copper or copper alloy, and stainless steel.

7. The electrical data connector according to claim 6, wherein a copper diffusing barrier layer is provided between said copper or copper alloy core and said other plated layer of gold.

8. The electrical data connector according to claim 7, wherein said barrier layer is selected from the group consisting of palladium and nickel.

9. The electrical data connector according to claim 8, wherein the respective layers have a thickness of from 30 to about 50 microinches.

10. In an electrical data connector having plural pairs of electrical conductors disposed in parallel relationship therewithin, where said connector may be operated at frequencies up to 300 MHz and insertion loss represents an operating performance limitation of said connector, the improvement comprising in combination therewith the provision of the incorporation within the connector of a shorting member to reduce insertion loss, said member comprising a plurality of coupling elements arranged in a staggered relationship, the number of which is equal to the number of pairs of said electrical conductors, each said element consisting of an oxidant resistant metal member, circular in cross section, and formed in a U-shaped configuration with a base portion and a pair of arms angularly disposed therefrom terminating in a pair of remote ends.

11. The electrical data connector according to claim 10, wherein said elements are arranged parallel to and insulated from one another, and said remote ends of said arms are arranged to contact a pair of said conductors.

12. The electrical data connector according to claim 11, wherein at least two said elements partially overlap such that the arm of one element is angularly disposed about 90° to the arm of said second element.

13. The electrical data connector according to claim 10, wherein said element comprises a tempered copper alloy core having an outer layer of gold and an intermediate layer of palladium.

14. The electrical data connector according to claim 10, wherein said element comprises a stainless steel.

15. The electrical data connector according to claim 10, wherein said element comprises a tempered copper alloy core having an outer layer of gold and an intermediate layer of nickel.

* * * * *